US011533975B2

(12) United States Patent
Lei et al.

(10) Patent No.: US 11,533,975 B2
(45) Date of Patent: Dec. 27, 2022

(54) HAIR DRYER AND AIR NOZZLE THEREOF

(71) Applicant: SHENZHEN CARKU TECHNOLOGY CO., LIMITED, Guangdong (CN)

(72) Inventors: Yun Lei, Guangdong (CN); Chuwei Liu, Guangdong (CN); Yubin Zhang, Guangdong (CN)

(73) Assignee: Shenzhen Carku Technology Co., Limited, Shenzhen (CN)

( * ) Notice: Subject to any disclaimer, the term of this patent is extended or adjusted under 35 U.S.C. 154(b) by 0 days.

(21) Appl. No.: 17/318,558

(22) Filed: May 12, 2021

(65) Prior Publication Data

US 2022/0142324 A1 May 12, 2022

(30) Foreign Application Priority Data

Nov. 10, 2020 (CN) ..... 202022593093.7

(51) Int. Cl.
*A45D 20/12* (2006.01)

(52) U.S. Cl.
CPC ..... *A45D 20/12* (2013.01)

(58) Field of Classification Search
CPC .. A45D 20/12; A45D 20/10; A45D 2020/128; A45D 20/00; A45D 20/122
USPC ..... 34/97, 96
See application file for complete search history.

(56) References Cited

U.S. PATENT DOCUMENTS

| | | | | |
|---|---|---|---|---|
| 2,817,000 | A * | 12/1957 | Scheid | A45D 20/08 392/383 |
| 9,808,067 | B2 | 11/2017 | Sutter et al. | |
| 9,936,788 | B2 | 4/2018 | Stephens et al. | |
| 2014/0144459 | A1* | 5/2014 | Fung | A45D 20/50 132/271 |

(Continued)

FOREIGN PATENT DOCUMENTS

| | | | | |
|---|---|---|---|---|
| GB | 2253351 | A * | 9/1992 | A61C 17/022 |
| JP | 2017-18593 | A | 1/2017 | |
| WO | 2015001306 | A1 | 1/2015 | |

OTHER PUBLICATIONS

The Extended European Search Report issued in corresponding EP Application No. EP21185144.9, dated Dec. 17, 2021.

(Continued)

*Primary Examiner* — Edelmira Bosques
*Assistant Examiner* — Bao D Nguyen
(74) *Attorney, Agent, or Firm* — Hauptman Ham, LLP

(57) ABSTRACT

The present disclosure provides a hair dryer, including an air duct and an air nozzle. The air nozzle includes an air nozzle housing defining an air outlet channel and a first adsorbing member. A first end of the air outlet channel is in air communication with an air outlet of the air duct. The first adsorbing member is arranged on the air nozzle housing close to the first end. A second adsorbing member is arranged on the air outlet. The second adsorbing member is arranged around the air outlet. The air nozzle is detachably coupled to the air outlet by adsorption, thus simplifying the installation of the air nozzle, facilitating the installation and replacement of the air nozzle, and thereby improving the user experience. The first adsorbing member is matched with the second adsorbing member to allow the air nozzle housing to be positioned on the air duct.

19 Claims, 7 Drawing Sheets

(56) References Cited

U.S. PATENT DOCUMENTS

| | | | | |
|---|---|---|---|---|
| 2016/0206075 | A1* | 7/2016 | Stephens | A45D 20/12 |
| 2016/0206077 | A1 | 7/2016 | Stephens et al. | |

OTHER PUBLICATIONS

The First Office Action issued in corresponding JP Application No. JP2021-093926, dated May 31, 2022.
The First Examiner's Report issued in corresponding AU Application No. 2021204997, dated Jun. 10, 2022.

* cited by examiner

HAIR DRYER AND AIR NOZZLE THEREOF

CROSS-REFERENCE TO RELATED APPLICATION

The present disclosure claims priority to and the benefit of Chinese Patent Application No. 202022593093.7, filed on Nov. 10, 2020, the entire disclosure of which is hereby incorporated by reference in its entirety.

TECHNICAL FIELD

The present disclosure relates to the technical field of a hair dryer, and more particularly to an air nozzle and a hair dryer including the air nozzle.

BACKGROUND

Currently, there are many types of air nozzles of hair dryers on the market. The existing air nozzles are generally coupled to air outlets of the hair dryers by screwing or clamping. However, when a user needs to replace different types of the air nozzles coupled to corresponding hair dryer, the replacement operation is cumbersome and inconvenient to use.

SUMMARY

The purpose of the present disclosure is aim to provide an air duct and a hair dryer including the air duct, which are convenient to install.

In order to solve the above problem, the present disclosure provides an air duct, which is detachably installed on an air duct of a hair dryer. The air nozzle includes an air nozzle housing and a first adsorbing member. The air nozzle housing defines an air outlet channel. The air duct defines an outlet hole. A first end of the air outlet channel of the air nozzle housing is in air communication with the air outlet of the air duct. The first adsorbing member is arranged on the air nozzle housing close to the first end of the air outlet channel. A second adsorbing member matched with the first adsorbing member is arranged on the air outlet of the air duct. The first adsorbing member is matched with the second adsorbing member to allow the air nozzle housing to be positioned on the air duct.

Preferably, the first adsorbing member is coupled to the air nozzle housing by clamping, gluing, or hot melt connection.

Preferably, a side of the air nozzle housing facing toward the second adsorbing member of the air duct defines a clamping groove, and the first adsorbing member is clamped in the clamping groove.

Preferably, the clamping groove is arranged at least one circle along a circumferential direction of the air outlet channel, and the first adsorbing member is a cyclic structure arranged in the clamping groove.

Preferably, the first adsorbing member is a magnet, and the second adsorbing member is a magnet; or the first adsorbing member is an iron ring, and the second adsorbing member is a magnet; or the first adsorbing member is a magnet, and the second adsorbing member is an iron ring.

Preferably, the air outlet channel comprises the first end and a second end opposite to the first end, an inside diameter of a port at the first end of the air outlet channel is greater than an inside diameter of a port at the second end of the air outlet channel. A radial dimension of the air outlet channel gradually decreases from the first end to the second end of the air outlet channel away from the first end.

The present disclosure provides a hair dryer, including an air duct and the air nozzle. The air duct comprises a main housing. One end of the main housing defines an air outlet. The air nozzle includes an air nozzle housing and a first adsorbing member. The air nozzle housing defines an air outlet channel. A first end of the air outlet channel of the air nozzle housing is in air communication with an air outlet of the air duct. The first adsorbing member is arranged on the air nozzle housing close to the first end of the air outlet channel. A second adsorbing member matched with the first adsorbing member is arranged on the air outlet of the air duct. The second adsorbing member is arranged around the air outlet. The first adsorbing member is matched with the second adsorbing member to allow the air nozzle housing to be positioned on the air duct.

Preferably, the air duct further includes a front housing. The front housing is coupled to the main housing. The second adsorbing member is fixed to the main housing by the front housing. The front housing defines a through hole corresponding to the air outlet. The second adsorbing member is a cyclic structure arranged around the air outlet. An outer side wall of the second adsorbing member arranges a flange. The front housing arranges a stopper on a hole wall of the through hole, and the flange is stopped by the stopper.

Preferably, the hair dryer further comprises a rechargeable battery arranged in the air duct, the second adsorbing member is an electromagnet electrically coupled to the rechargeable battery, and the first adsorbing member is a magnet or an iron block.

Preferably, a side surface of the air nozzle facing toward the air duct arranges an annular protrusion, and the protrusion is hermetically fitted to an inner side wall of the air outlet.

The present disclosure provides the air nozzle of the hair dryer, which arranges the first adsorbing member, and the air duct of the hair dryer, which arranges a second adsorbing member around the air outlet. The air nozzle is detachably coupled to the air outlet of the hair dryer by adsorption, but not by screwing or clamping, thus simplifying the installation of the air nozzle, facilitating the installation and replacement of the air nozzle, and thereby improving the user experience.

BRIEF DESCRIPTION OF THE DRAWINGS

In order to more clearly illustrate the technical solution of the present disclosure, the accompanying drawings required for describing the embodiments or the prior art will be briefly described below. Apparently, the accompanying drawings in the following description are merely the embodiments of the present disclosure, and other drawings may be obtained by those skilled in the art according to these accompanying drawings without paying any creative labor.

DETAILED DESCRIPTION

Figure 1:
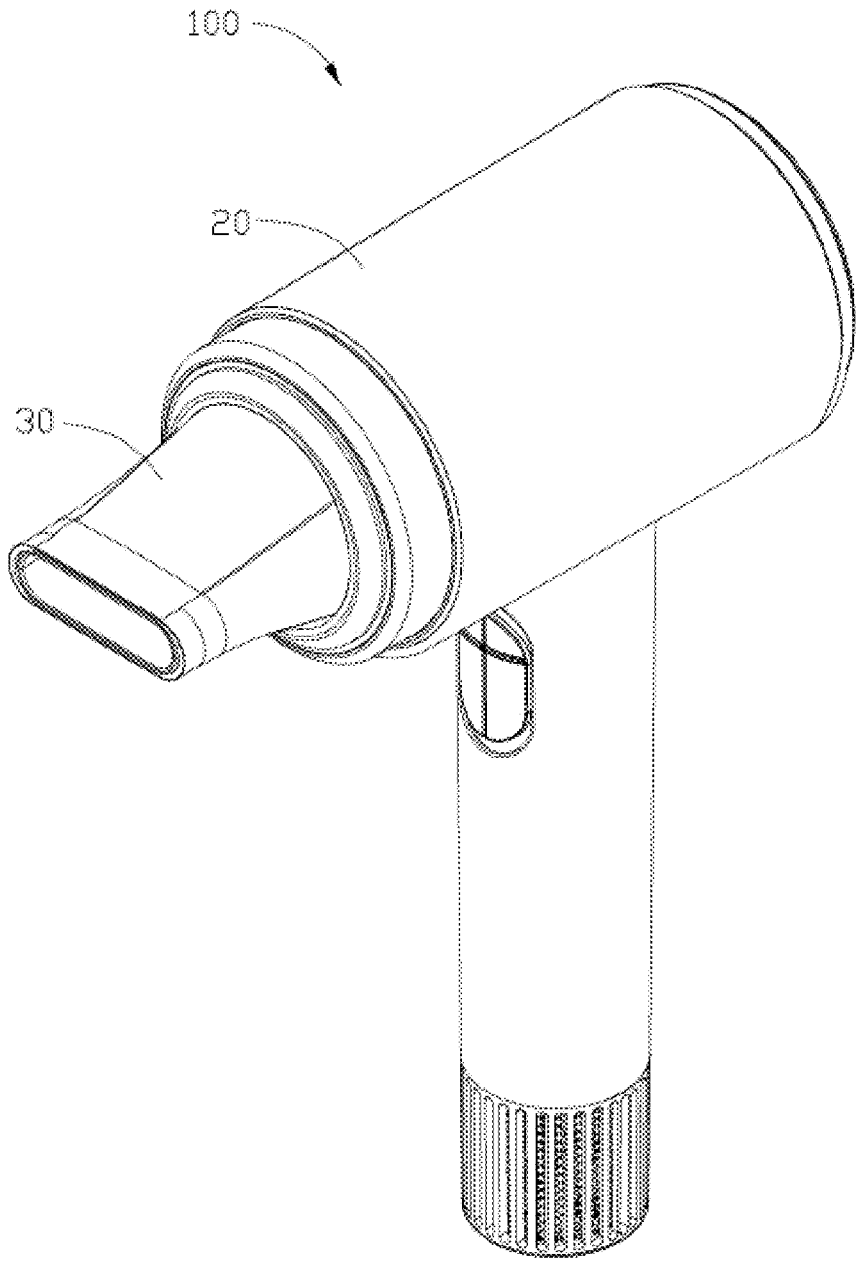
FIG. 1 is a schematic diagram of a three-dimensional structure of a hair dryer provided by an embodiment of the present disclosure.

The technical solutions in the embodiments of the present disclosure will be clearly and completely described in the following with reference to the accompanying drawings in the embodiments of the present disclosure. Apparently, the described embodiments are merely some but not all of the embodiments of the present disclosure. All other embodiments obtained by a person of ordinary skill in the art based on the embodiments of the present disclosure without creative efforts shall fall within the protection scope of the present disclosure.

In the description of the embodiments of the present disclosure, it should be apprehended that the orientation or positional relationship indicated by the terms, such as the term "thickness", is based on the orientation or positional relationship shown in the drawings, and is only for the convenience of describing the present disclosure and simplifying the description. It does not imply or indicate that the pointed device or element must be in a specific orientation, or be constructed and operated in a specific orientation, therefore cannot be understood as a limitation of the present disclosure.

Figure 2:
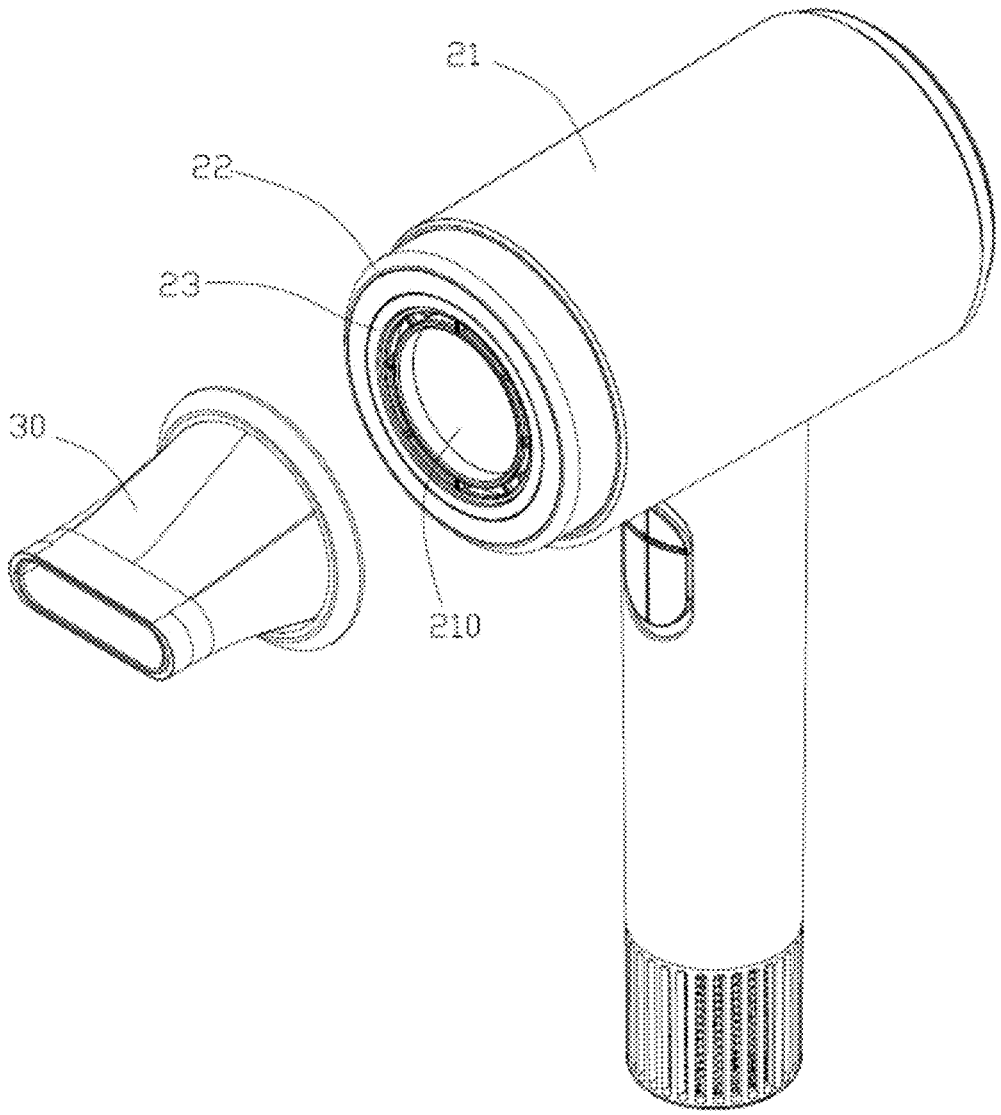
FIG. 2 is an exploded schematic view of the three-dimensional structure of an air nozzle and an air duct of the hair dryer of FIG. 1.
Figure 3:
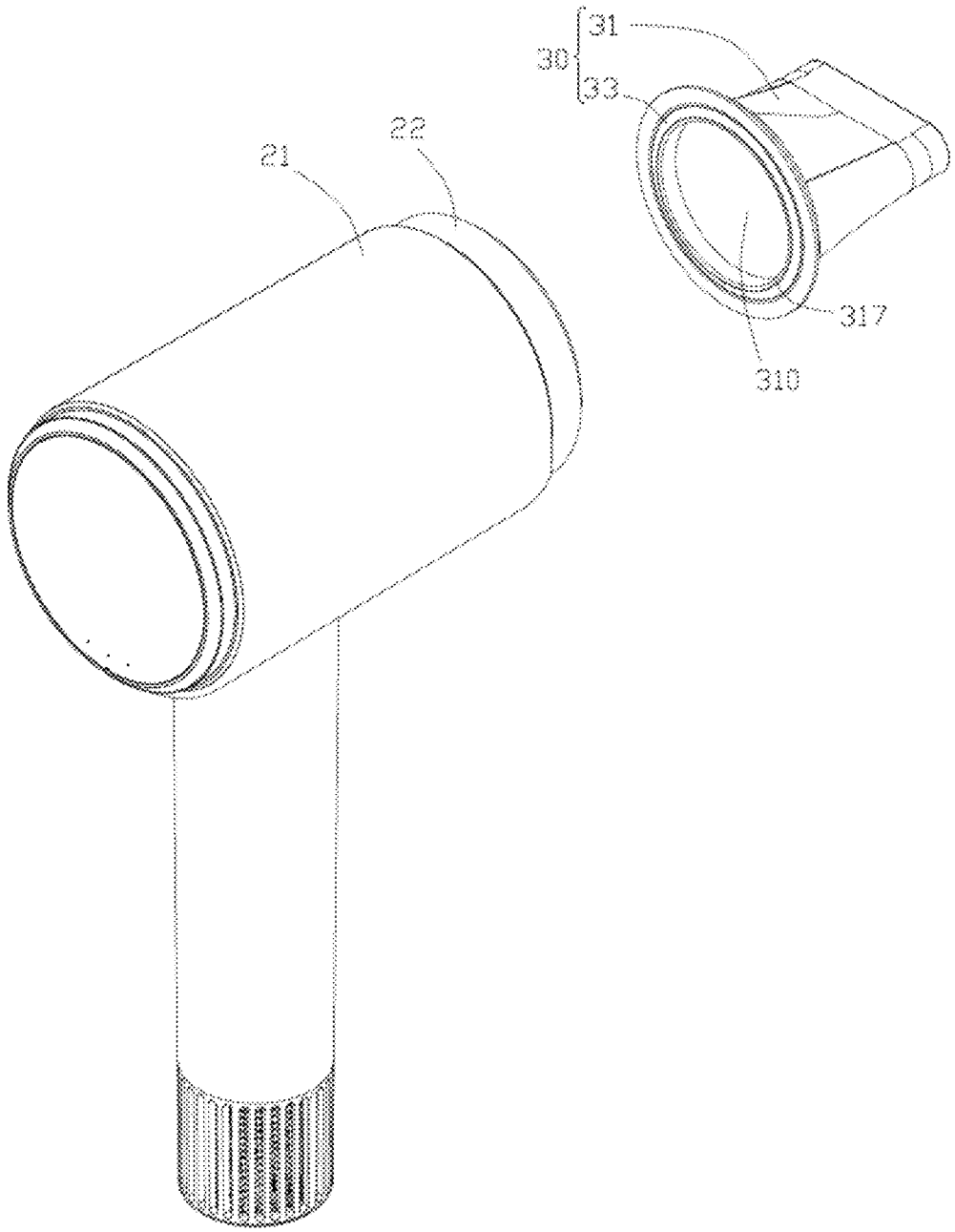
FIG. 3 is the schematic view of the three-dimensional structure of FIG. 2, but viewed from another aspect.

As illustrated in FIG. 1 to FIG. 3, the present disclosure provides a hair dryer 100, which includes an air duct 20 and an air nozzle 30. The air duct 20 includes a main housing 21 and a front housing 22. One end of the front housing 22 defines an air outlet 210. The air nozzle 30 is detachably installed on the air duct 20. The air nozzle 30 includes an air nozzle housing 31 and a first adsorbing member 33. The air nozzle housing 31 defines an air outlet channel 310. The air duct 20 defines an outlet hole 210. A first end of the air outlet channel 310 of the air nozzle housing 31 is in air communication with the air outlet 210 of the air duct 20. The first adsorbing member 33 is arranged on the air nozzle housing 31 close to the first end of the air outlet channel 310. A second adsorbing member 23 matched with the first adsorbing member 33 is arranged on the air outlet 210 of the air duct 20. The first adsorbing member 33 is matched with the second adsorbing member 23 to allow the air nozzle housing 31 to be positioned on the air duct 20. Specifically, the first adsorbing member 33 is arranged around the air outlet channel 310 of the air nozzle housing 31, and the second adsorbing member 23 is arranged around the air outlet 210.

In the embodiment, the first adsorbing member 33 is a cyclic structure surrounding the first end of the air outlet channel 310. The second adsorbing member 23 is a cyclic structure surrounding the air outlet 210. The first adsorbing member 33 and the second adsorbing member 23 are adsorbed to each other, to allow the air nozzle 30 to be detachably coupled to the air duct 20. Preferably, when the first adsorbing member 33 is adsorbed on the second adsorbing member 23, an axis of the first adsorbing member 33 is colinear with an axis of the second adsorbing member 23.

The present disclosure provides the air nozzle 30 of the hair dryer 100, which arranges the first adsorbing member 33, and the air duct 20 of the hair dryer 100, which arranges the second adsorbing member 23 around the air outlet 210. The air nozzle 30 is coupled to the air duct 20 by the adsorbing of the first adsorbing member 33 and the second adsorbing member 23. The air nozzle 30 is coupled to the air outlet 210 of the hair dryer 100 by adsorption, but not by screwing or clamping, thus simplifying the installation of the air nozzle 30, facilitating the installation and replacement of the air nozzle 30, and thereby improving the user experience.

As illustrated in FIG. 2 to FIG. 5, the first adsorbing member 33 is coupled to the air nozzle housing 31 by clamping, gluing, or hot melt connection. In the embodiment, the first adsorbing member 33 is coupled to the air nozzle housing 31 by clamping. Specifically, the air nozzle housing 31 includes an air outlet duct 311 and a connecting ring 313 arranged at one end of the air outlet duct 311 close to the air duct 20. The first adsorbing member 33 is clamped to one side of the connecting ring 313 facing away from the air outlet duct 311. That is, the air outlet duct 311 includes a first end and a second end opposite to the first end. The connecting ring 313 is arranged on the first end of the air outlet duct 311. One side of the air nozzle housing 31 facing toward the second adsorbing member 23 of the air duct 20 defines a clamping groove 315. The first adsorbing member 33 is clamped in the clamping groove 315. An inner cavity of the connecting ring 313 is in air communication with an inner cavity of the air nozzle housing 311 to form the air outlet channel 310.

The clamping groove 315 is arranged at least one circle along a circumferential direction of the air outlet channel 310. The first adsorbing member 33 is a cyclic structure arranged in the clamping groove 315. Specifically, the clamping groove 315 is an annular groove arranged on a side surface of the connecting ring 313 facing toward the air duct 20 and around the air outlet channel 310. An axis of the clamping groove 315 is collinear with an axis of the connecting ring 313. The connecting ring 313 is fixedly coupled to the air outlet duct 311, and a projection of the air outlet duct 311 on the connecting ring 313 falls into the connecting ring 313. The connecting ring 313 can be coupled to the air nozzle housing 311 to form a whole by clamping or gluing. The connecting ring 313 and the air nozzle housing 311 can also be made in one piece.

A side surface of the air nozzle housing 31 of the air nozzle 30 arranging the first adsorbing member 33 arranges an annular protrusion 317. The protrusion 317 is hermetically fitted to an inner side wall of the air outlet 210. Specifically, the protrusion 317 protrudes from a side surface of the connecting ring 313 facing away from the air outlet duct 311. The protrusion 317 surrounds the connecting ring 313 in a circle. The first absorbing member 33 is sleeved on the protrusion 317, that is an inner side wall of the first suction member 33 abuts against an outer side wall of the protrusion 317. An end of the protrusion 317 adjacent to the air duct 20 is exposed outwardly from the first absorbing member 33. In the embodiment, the protrusion 317 is closer to an inner side wall of the connecting ring 313 than the clamping groove 315. Specifically, the protrusion 317 is adjacent to the clamping groove 315, and a distance between the protrusion 317 and the air outlet channel 310 is smaller than that between the clamping groove 315 and the air outlet channel 310. Preferably, an inner side wall of the protrusion 317 is coplanar with the inner side wall of the connecting ring 313, and an outer side wall of the protrusion 317 is one of the side walls of the clamping groove 315. The inner side wall of the protrusion 317 and a channel wall of the air outlet channel 310 are smoothly transitioned and coupled, thus reducing the wind resistance and improving the user experience.

Figure 7:
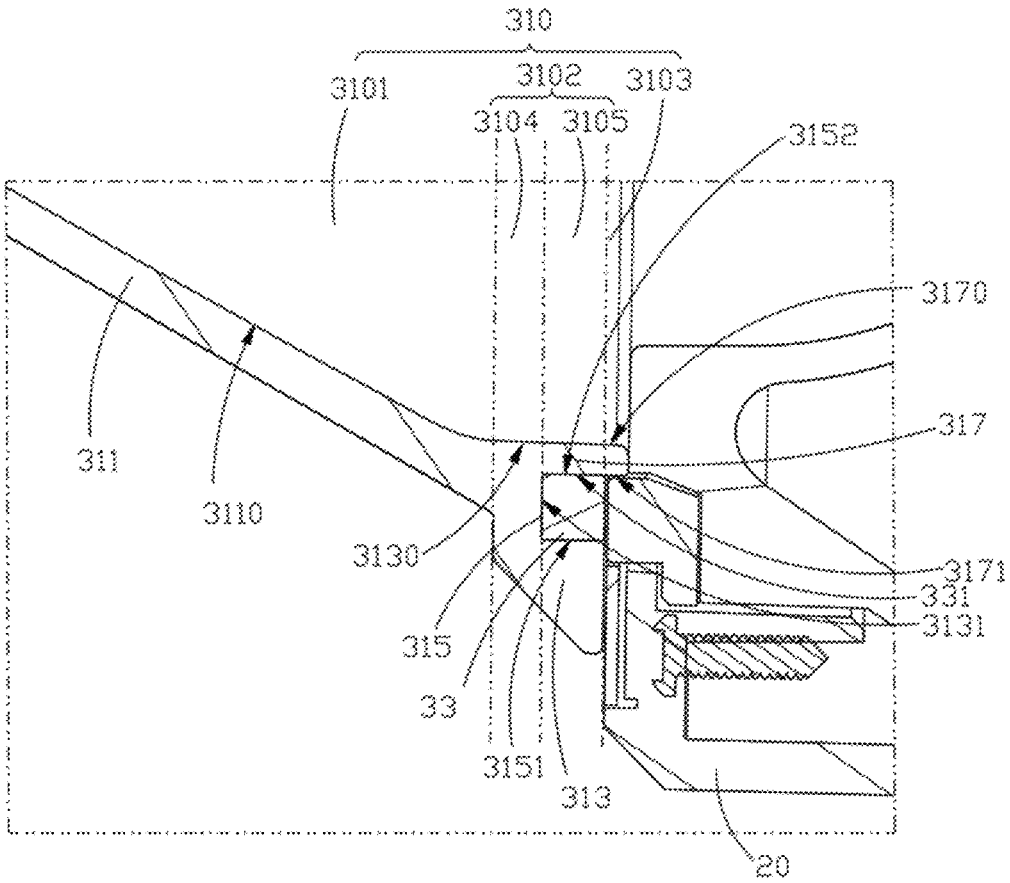
FIG. 7 is an enlarged view of a portion B of FIG. 6.

As illustrated in FIG. 7, an inner cavity 3103 of the annular protrusion 317 is in air communication with an inner cavity 3101 of the air outlet duct 311 to reduce wind resistance. Specifically, an annular protrusion 317 is arranged on a right side surface 3131 of the connecting ring 313 facing away from the air outlet duct 311 and facing toward to the air duct 20. An inner cavity 3102 of the connecting ring 313 includes a first cavity 3104 and a second cavity 3105 on an air path. The first cavity 3104 is adjacent to an inner cavity 3103 of the annular protrusion 317 and an inner cavity 3101 of the air outlet duct 311. The second cavity 3105 is partially overlapped with the inner cavity 3103 of the annular protrusion 317. An inner side wall 3170 of the annular protrusion 317, an inner radial wall 3130 of the first cavity 3104 of the connecting ring 313, and an inner radial wall 3110 of the air outlet duct 311 form a channel wall of the air outlet channel 310 to allow the inner cavity 3103 of the annular protrusion 317 to be in air communication with the first cavity 3104 of the connecting ring 313 and the inner cavity 3101 of the air outlet duct 311. The inner radial wall 3130 of the first cavity 3104 of the connecting ring 313 is coupled to the side surface 3131 of the connecting ring 313, and is coplanar with the inner radial wall 3170 of the annular protrusion 317. An inner radial wall 331 of the first adsorbing member 33 abuts against an outer radial wall 3171 of the annular protrusion 317. The clamping groove 315 includes an outer radial side wall 3151 and an inner radial side wall 3152 faced to the outer radial side wall 3151, and the outer radial wall 3171 of the annular protrusion 317 is the inner radial side wall 3152 of the clamping groove 315.

In other embodiments, the first adsorbing member 33 may be structured as a rectangular ring, a square ring, an elliptical ring, or other ring structures. The clamping groove 315 is correspondingly structured as a rectangular ring groove, a square ring groove, or an elliptical ring groove, such that the first adsorbing member 33 is clamped in the clamping groove 315. A shape of the second adsorbing member 23 substantially corresponds to a shape of the first adsorbing member 33. The second adsorbing member 23 is structured as a rectangular ring, a square ring, an elliptical ring, or other ring structures.

In the embodiment, the first adsorbing member 33 is a magnet. The second adsorbing member 23 is also a magnet. A side of the first adsorbing member 33 facing toward the second adsorbing member 23 is a cathode, and a side of the second adsorbing member 23 facing toward the first adsorbing member 33 is an anode. In other embodiments, the side of the first adsorbing member 33 side of the first adsorbing member 33 facing toward the second adsorbing member 23 is an anode, and the side of the second adsorbing member 23 facing toward the first adsorbing member 33 is a cathode.

In other embodiments, the first adsorbing member 33 is an iron ring, and the second adsorbing member 23 is a magnet; or, the first adsorbing member 23 is a magnet, and the second adsorbing member 23 is an iron ring.

In other embodiments, the air duct 20 arranges a rechargeable battery 27. The second adsorbing member 23 is an electromagnet electrically coupled to the rechargeable battery 27. The first adsorbing member 33 is a magnet or an iron block. Specifically, in one embodiment, the second adsorbing member 23 is always electrically coupled to the rechargeable battery 27, to allow the second adsorbing member 23 to maintain magnetism, such that the first adsorbing member 33 can be adsorbed to the second adsorbing member 23. In another embodiment, the air duct 20 is also provided with a switch for controlling the second adsorbing member 23 electrically connect or disconnect the rechargeable battery 27. When the air nozzle 30 needs to be used, the switch is turned on to allow the second adsorbing member 23 to have magnetism, thus facilitating the adsorbing connection between the first adsorbing member 33 and the second adsorbing member 23. When the air nozzle 30 needs to be removed, the switch is turned off to allow an electrical connection between the second adsorbing member 23 and the rechargeable battery 27 to be broken, and to allow the magnetism of the second adsorbing member 23 to disappear, such that it is convenient to remove the air nozzle 30.

The air outlet channel 310 includes the first end 3101 and a second end 3103 opposite to the first end 3101. An inside diameter of a port 3102 at the first end 3101 of the air outlet channel 310 is greater than an inside diameter of a port 3104 at a second end 3103 opposite to the first end 3101, such that the wind generated by the hair dryer 100 can be concentrated. In the embodiment, the port 3102 at the first end 3101 of the air outlet channel 310 is a circular hole. The port 3104 at the second end 3103 of the air outlet channel 310 is a waist-shaped hole. An area of the port 3102 at the first end 3101 of the air outlet channel 310 is greater than that of the second end 3103 of the air outlet channel 310.

Preferably, a radial dimension of the air outlet channel gradually decreases from the first end 3101 to the second end 3103 of the air outlet channel 310 away from the first end 3101.

Figure 4:
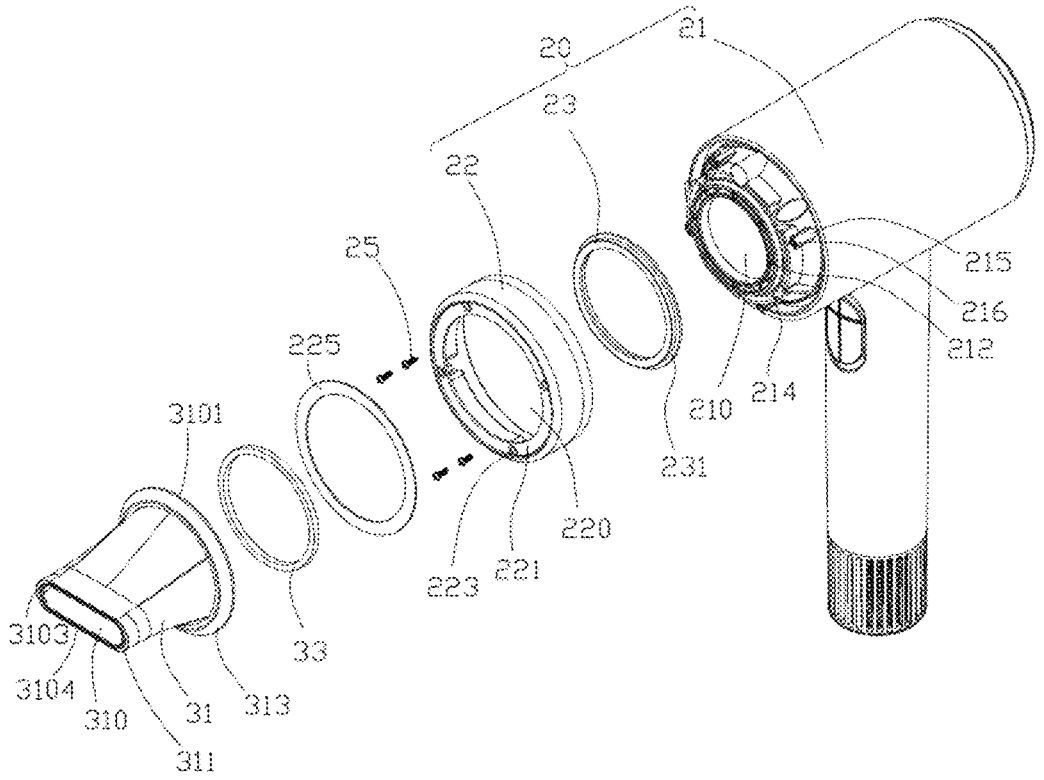
FIG. 4 is another exploded schematic view of a three-dimensional structure of an air nozzle and an air duct of the hair dryer of FIG. 1.
Figure 5:
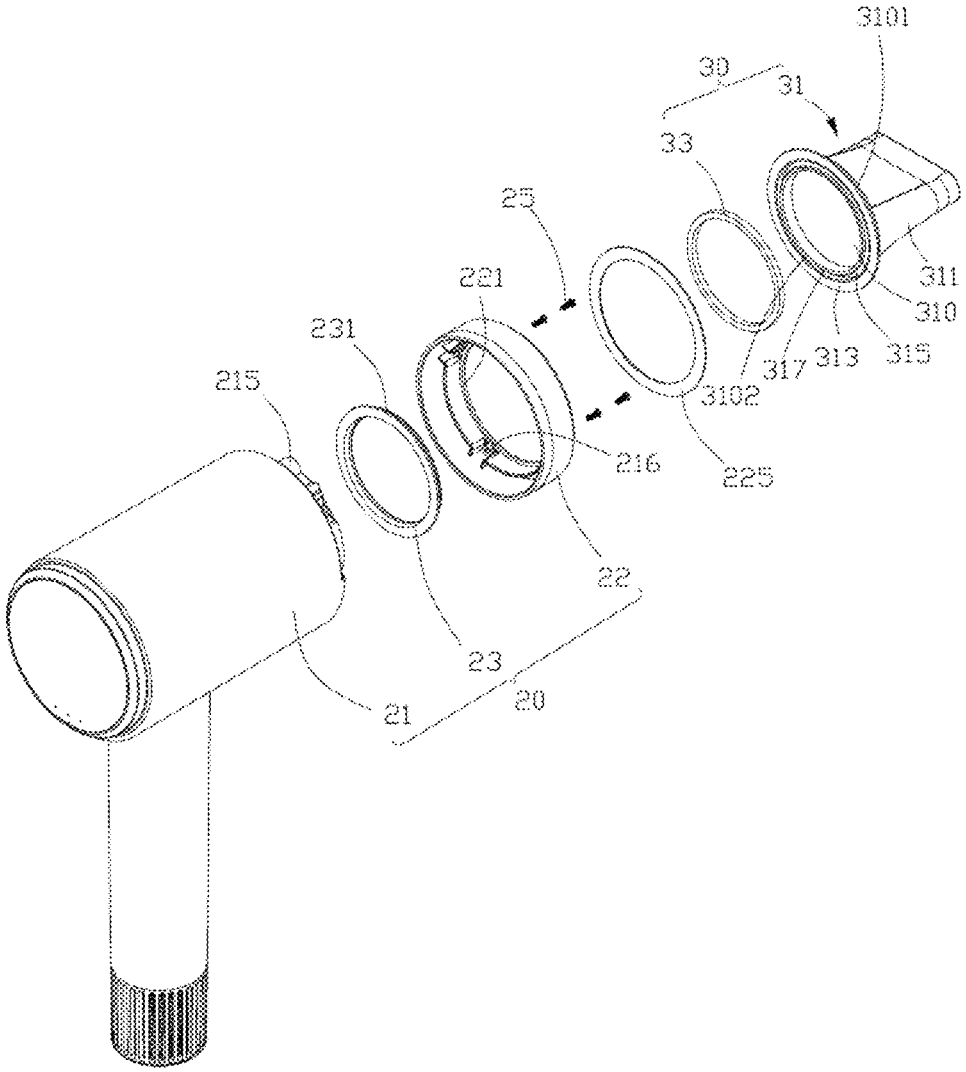
FIG. 5 is the schematic view of the three-dimensional structure of the air nozzle and the air duct of FIG. 4, but viewed from another aspect.

As illustrated in FIG. 4 and FIG. 5, the front housing 22 is coupled to the main housing 21. The second adsorbing member 23 is fixed to the main housing 21 by the front housing 22. Specifically, the second adsorbing member 23 is clamped and fixed by the front housing 22 and the main housing 21. That is, the second absorbing member 23 is sandwiched between the main housing 21 and the front housing 22. The main housing 21 protrudes a clamping ring 212 in an axial direction of the main housing 21 around the air outlet 210. The main housing 21 defines a positioning groove 214 in a circle around the clamping ring 212. The second adsorbing member 23 is sleeved on the clamping ring 212 and is positioned in the positioning groove 214. The hair dryer further includes a locking structure 25, and the front housing 22 is fixedly coupled to the main housing 21 by the locking structure 25. The locking structure 25 includes, but is not limited to, a buckle structure, a magnetic adsorption structure, an internal and external thread structure, a bolt structure, and the like. The main housing 21 arranges a plurality of connecting columns 215 around the positioning groove 214. Each of the plurality of connecting columns 215 defines a locking hole 216 along an axial direction of corresponding connecting column 215. In the embodiment, the locking structure 25 includes a plurality of locking members, such as screws. Each of the plurality of locking members passing through the front housing 22 is locked in a corresponding locking hole 216, such that the front housing 22 is fixedly coupled to the main housing 21.

The front housing 22 defines a through hole 220 corresponding to the air outlet 210. The second adsorbing member 23 is a cyclic structure around the air outlet 210. An outer side surface of the second adsorbing member 23 protrudes a flange 231. The front housing 22 arranges a stopper 221 on a hole wall of the through hole 220, and the flange 213 is stopped by the stopper 221. An end of the second absorbing member 23 away from the flange 231 passes through the through hole 220 to abut against the first absorbing member 33. Specifically, the front housing 22 is substantially a cyclic structure. The stopper 221 is an annular piece arranged on a side of the inner side surface of the front housing 22 away from the main housing 21. The stopper 221 defines a plurality of through holes 223 corresponding to the plurality of the locking holes 216 of the main housing 21.

Preferably, the front housing 22 further includes a decorative ring 225. The decorative ring 225 is fitted to a side surface of the stopper 221 facing away from the main housing 21, and the decorative ring 225 covers the locking structure. That is, the decorative ring 225 covers the plurality of through holes 223 on the stopper 221, thus avoiding dust and other impurities in the air from entering the hair dryer 100, and avoiding air leakage of the hair dryer 100. Specifically, the side surface of the stopper 221 facing away from the main housing 21 defines a receiving groove. The decorative ring 225 is fixed in the receiving groove by clamping or gluing.

Figure 6:
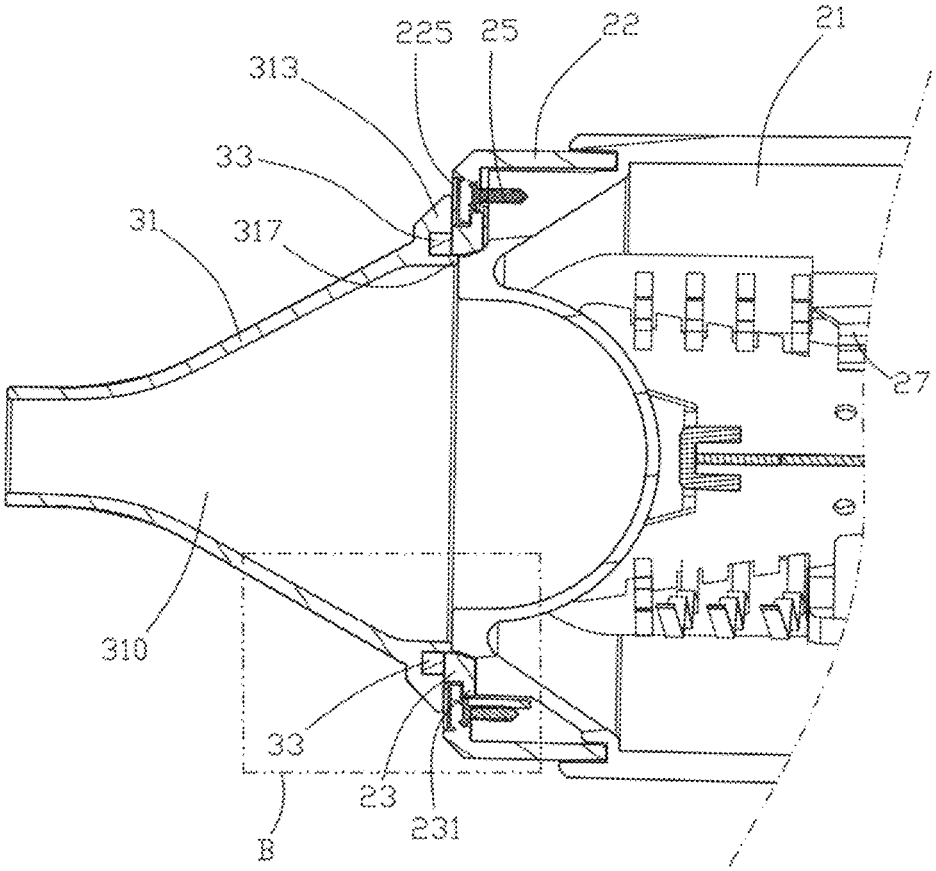
FIG. 6 is a partial cross-sectional view of the hair dryer of FIG. 1.

As illustrated in FIG. 4 to FIG. 6, when assembling the first absorbing member 33 to the air nozzle housing 31, the first absorbing member 33 is sleeved on the protrusion 317 and is clamped in the clamping groove 315. When assembling the second absorbing member 23 to the main housing 21, the second absorbing member 23 is sleeved on the clamping ring 212 and is received in the positioning groove 214. The front housing 22 is covered on the second absorbing member 23 until the stopper 221 of the front housing 22 is overlapped on the flange 231 of the second adsorbing member 23, and the plurality of through holes 223 of the front housing 22 are respectively aligned with the plurality of locking holes 216 of the main housing 21. The plurality of locking members are inserted into the plurality of through holes 223 and locked in the plurality of locking holes 216, respectively. Such that the front housing 22 is fixedly coupled to the main housing 21, and the second adsorbing member 23 is clamped and fixed between the front housing 22 and the main housing 21. The decorative ring 225 is installed in the receiving groove of the front housing 22. At this time, a side surface of the second absorbing member 23 facing away from the flange 231 is exposed outwardly from the through hole 220, and is coplanar with an outer surface of the decorative ring 225.

As illustrated in FIG. 1 to FIG. 3 and FIG. 6, when the air nozzle 30 needs to be used, the protrusion 317 of the air nozzle 30 is inserted into the air outlet 210 of the air duct 20. The first adsorbing member 33 is adsorbed on the second adsorbing member 23 to allow the air nozzle 30 to be coupled to the air duct 20, thus facilitating the installation. At this time, the air outlet channel 310 of the air nozzle 30 is in air communication with the air outlet 210 of the air duct 20, and the outer side wall of the protrusion 317 is hermetically fitted to the inner side wall of the second adsorbing member 23, thus preventing the wind generated by the air duct 20 leaking from a connection between the air nozzle 30 and the air duct 20. When the air nozzle 30 needs to be removed from the air nozzle 30, one end of the air nozzle 30 away from the main housing 21 is pulled to release an adsorption force between the first adsorbing member 33 and the second adsorbing member 23, such that it is easy to use and simple to operate.

The foregoing description merely depicts some exemplary embodiments of the disclosure. It should be understood that, those skilled in the art may also make a plurality of improvements and refinements without departing from the principles of the present disclosure. The plurality of improvements and refinements should all be encompassed within the protection of the present disclosure.

What is claimed is:

1. An air nozzle, which is detachably installed on an air duct of a hair dryer, wherein the air nozzle comprises an air nozzle housing and a first adsorbing member, the air nozzle housing defines an air outlet channel, the air nozzle housing includes an air outlet duct and a connecting ring arranged at one end of the air outlet duct adjacent to the air duct, the air duct defines an air outlet, a first end of the air outlet channel of the air nozzle housing is in air communication with the air outlet of the air duct, the first adsorbing member is arranged on the air nozzle housing close to the first end of the air outlet channel, a second adsorbing member matched with the first adsorbing member is arranged on the air outlet of the air duct, the first adsorbing member is matched with the second adsorbing member to allow the air nozzle housing to be positioned on the air duct, an annular protrusion is arranged on a right side surface of the connecting ring facing away from the air outlet duct and facing toward to the air duct, the annular protrusion is hermetically fitted to an inner radial wall of the air outlet, an inner cavity of the connecting ring comprises a first cavity and a second cavity on an air path, the first cavity is adjacent to an inner cavity of the annular protrusion and an inner cavity of the air outlet duct, the second cavity is partially overlapped with the inner cavity of the annular protrusion;

an inner radial wall of the annular protrusion, an inner radial wall of the connecting ring, and an inner radial wall of the air outlet duct form a channel wall of the air outlet channel to allow an inner cavity of the annular protrusion to be in air communication with the first cavity of the connecting ring and the inner cavity of the air outlet duct, and the inner radial wall of the first cavity of the connecting ring is coupled to the right side surface of the connecting ring, and is coplanar with the inner radial wall of the annular protrusion.

2. The air nozzle of claim 1, wherein a right side of the air nozzle housing facing toward the second adsorbing member of the air duct defines a clamping groove, and the first adsorbing member is clamped in the clamping groove.

3. The air nozzle of claim 2, wherein the clamping groove is arranged at least one circle along a circumferential direction of the air outlet channel, and the first adsorbing member is a cyclic structure arranged in the clamping groove.

4. The air nozzle of claim 2, wherein the annular protrusion is adjacent to the clamping groove, and a distance between the annular protrusion and a central axis of the air outlet channel is smaller than that between the clamping groove and the central axis of the air outlet channel.

5. The air nozzle of claim 2, wherein the clamping groove comprises an outer radial side wall and an inner radial side wall faced to the outer radial side wall, and an outer radial wall of the annular protrusion is the inner radial side wall of the clamping groove.

6. The air nozzle of claim 1, wherein the first adsorbing member is a magnet and the second adsorbing member is a magnet; or the first adsorbing member is an iron ring and the second adsorbing member is a magnet; or the first adsorbing member is a magnet and the second adsorbing member is an iron ring; or the first adsorbing member is a magnet or an iron block and the second adsorbing member is an electromagnet.

7. The air nozzle of claim 1, wherein the first adsorbing member is sleeved on the annular protrusion, and an end of the annular protrusion adjacent to the air duct is exposed outwardly from the first adsorbing member.

8. The air nozzle of claim 1, the first adsorbing member is clamped on a side of the connecting ring facing away from the air outlet duct.

9. A hair dryer, comprising an air duct and an air nozzle; wherein the air duct comprises a main housing, one end of the main housing defines an air outlet, the air nozzle comprises an air nozzle housing and a first adsorbing member, the air nozzle housing defines an air outlet channel, a first end of the air outlet channel of the air nozzle housing is in air communication with the air outlet of the air duct, the first adsorbing member is arranged on the air nozzle housing close to the first end of the air outlet channel, a second adsorbing member matched with the first adsorbing member is arranged on the air outlet of the air duct, the second adsorbing member is arranged around the air outlet, the air nozzle housing includes an air outlet duct and a connecting ring arranged at one end of the air outlet duct adjacent to the air duct, the first adsorbing member is matched with the second adsorbing member to allow the air nozzle housing to be positioned on the air duct, an annular protrusion is arranged on a right side surface of the connecting ring facing away from the air outlet duct and facing toward to the air duct, the annular protrusion is hermetically fitted to an inner radial wall of the air outlet, an inner cavity of the connecting ring comprises a first cavity and a second cavity on an air path, the first cavity is adjacent to an inner cavity of the annular protrusion and an inner cavity of the air outlet duct, the second cavity is partially overlapped with the inner cavity of the annular protrusion;

an inner radial wall of the annular protrusion, an inner radial wall of the connecting ring, and an inner radial wall of the air outlet duct form a channel wall of the air outlet channel to allow an inner cavity of the annular protrusion to be in air communication with the first cavity of the connecting ring and the inner cavity of the air outlet duct, and the inner radial wall of the first cavity of the connecting ring is coupled to the right side surface of the connecting ring, and is coplanar with the inner radial wall of the annular protrusion.

10. The hair dryer of claim 9, wherein the air duct further comprises a front housing, the front housing is coupled to the main housing, the second adsorbing member is fixed to the main housing by the front housing, the front housing defines a through hole corresponding to the air outlet, the second adsorbing member is a cyclic structure arranged around the air outlet, an outer radial wall of the second adsorbing member arranges a flange, the front housing arranges a stopper on a hole wall of the through hole, and the flange is stopped by the stopper.

11. The hair dryer of claim 10, wherein the hair dryer further comprises a locking structure, and the front housing is fixedly coupled to the main housing by the locking structure.

12. The hair dryer of claim 11, wherein the hair dryer further comprises a decorative ring, the decorative ring is attached to a side of the stopper facing away from the main housing, and the decorative ring covers the locking structure.

13. The hair dryer of claim 12, wherein the decorative ring is fitted to a left side surface of the stopper facing away from the main housing.

14. The hair dryer of claim 12, wherein a left side surface of the stopper facing away from the main housing defines a receiving groove for receiving the decorative ring, and the decorative ring is fixed in the receiving groove by clamping or gluing.

15. The hair dryer of claim 10, wherein an end of the second adsorbing member away from the flange passes through the through hole to abut against the first adsorbing member.

16. The hair dryer of claim 10, wherein the second adsorbing member is sandwiched between the main housing and the front housing.

17. The hair dryer of claim 9, wherein the hair dryer further comprises a rechargeable battery arranged in the air duct, the second adsorbing member is an electromagnet electrically coupled to the rechargeable battery, and the first adsorbing member is a magnet or an iron block.

18. The hair dryer of claim 9, wherein an inner radial wall of the first adsorbing member abuts against an outer radial wall of the annular protrusion.

19. The air nozzle of claim 1, wherein an inner radial wall of the first adsorbing member abuts against an outer radial wall of the annular protrusion.

* * * * *